US010739692B2

(12) United States Patent
Komai et al.

(10) Patent No.: US 10,739,692 B2
(45) Date of Patent: Aug. 11, 2020

(54) IMAGE FORMING APPARATUS AND IMAGE FORMING METHOD

(71) Applicants: Kunihiro Komai, Kanagawa (JP); Shinji Minami, Kanagawa (JP)

(72) Inventors: Kunihiro Komai, Kanagawa (JP); Shinji Minami, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/444,317

(22) Filed: Jun. 18, 2019

(65) Prior Publication Data

US 2019/0384203 A1 Dec. 19, 2019

(30) Foreign Application Priority Data

Jun. 19, 2018 (JP) ..... 2018-116174

(51) Int. Cl.
*G03G 15/02* (2006.01)
*G03G 15/00* (2006.01)

(52) U.S. Cl.
CPC ..... *G03G 15/0266* (2013.01); *G03G 15/80* (2013.01)

(58) Field of Classification Search
CPC . G03G 15/0266; G03G 15/0283; G03G 15/80
See application file for complete search history.

(56) References Cited

U.S. PATENT DOCUMENTS

| | | | |
|---|---|---|---|
| 2013/0164017 | A1 | 6/2013 | Komai et al. |
| 2014/0270864 | A1 | 9/2014 | Yashiro et al. |
| 2015/0093137 | A1 | 4/2015 | Minami |
| 2015/0139674 | A1 | 5/2015 | Sugiyama et al. |
| 2017/0255122 | A1 | 9/2017 | Minami |
| 2019/0033772 | A1 | 1/2019 | Komai |

FOREIGN PATENT DOCUMENTS

| | | |
|---|---|---|
| JP | 2011-013431 | 1/2011 |
| JP | 2014-016651 | 1/2014 |
| JP | 2015-152850 | 8/2015 |

*Primary Examiner* — Erika J Villaluna
(74) *Attorney, Agent, or Firm* — Harness, Dickey & Pierce, P.L.C.

(57) ABSTRACT

An image forming apparatus includes a rotatable photoconductor, a charging device, a voltage applying device, a current detection device, and control circuitry. The control circuitry is configured to determine a film thickness of the photoconductor based on a charging current detected with the current detection device; determine an estimated film thickness of the film thickness, based on a previous film thickness and travel information of the photoconductor after determination of the previous film thickness; determine a discharging start voltage that the voltage applying device applies to start discharging from the charging device to the photoconductor; determine, from the estimated film thickness and the discharging start voltage, a film thickness determining voltage that the voltage applying device applies to pass a film thickness determining current being a charging current used for determining the film thickness; and apply the film thickness determining voltage to the charging device to determine the film thickness.

15 Claims, 8 Drawing Sheets

FIG. 7

| TRAVEL DISTANCE TD [m] OF PHOTOCONDUCTOR (A<B<C<D) | TD < A | A ≤ TD < B | B ≤ TD < C | C ≤ TD < D | TD ≥ D |
|---|---|---|---|---|---|
| PREVIOUS FILM THICKNESS [μm] | PRESENT FILM THICKNESS [μm] | | | | |
| 15 | 15 | 14 | 13 | 12 | 11 |
| 20 | 20 | 19 | 18 | 17 | 16 |
| 25 | 25 | 24 | 23 | 22 | 21 |
| 30 | 30 | 29 | 28 | 27 | 26 |
| 35 | 35 | 34 | 33 | 32 | 31 |

FIG. 10

| ENVIRONMENT INFORMATION | LL | MM | HH |
|---|---|---|---|
| ESTIMATED FILM THICKNESS [μm] | DISCHARGING START VOLTAGE | | |
| 15 | Vth1L | Vth1M | Vth1H |
| 20 | Vth2L | Vth2M | Vth2H |
| 25 | Vth3L | Vth3M | Vth3H |
| 30 | Vth4L | Vth4M | Vth4H |
| 35 | Vth5L | Vth5M | Vth5H |

FIG. 11

| ENVIRONMENT HISTORY INFORMATION | LL | MM | HH |
|---|---|---|---|
| ESTIMATED FILM THICKNESS [μm] | DISCHARGING START VOLTAGE | | |
| 15 | Vth1L | Vth1M | Vth1H |
| 20 | Vth2L | Vth2M | Vth2H |
| 25 | Vth3L | Vth3M | Vth3H |
| 30 | Vth4L | Vth4M | Vth4H |
| 35 | Vth5L | Vth5M | Vth5H |

IMAGE FORMING APPARATUS AND IMAGE FORMING METHOD

CROSS-REFERENCE TO RELATED APPLICATION

This patent application is based on and claims priority pursuant to 35 U.S.C. § 119(a) to Japanese Patent Application No. 2018-116174, filed on Jun. 19, 2018, in the Japan Patent Office, the entire disclosure of which is hereby incorporated by reference herein.

BACKGROUND

Technical Field

Embodiments of the present disclosure relate to an image forming apparatus and an image forming method.

Related Art

An electrophotographic image forming apparatus is known that measures the film thickness of a photoconductor based on the voltage-current characteristics obtained when voltage is applied to the photoconductor via a charging member.

SUMMARY

In an embodiment of the present disclosure, there is provided an image forming apparatus that includes a rotatable photoconductor, a charging device, a voltage applying device, a current detection device, and control circuitry. The charging device is configured to apply a voltage to the photoconductor to charge the photoconductor. The voltage applying device is configured to apply the voltage to the charging device. The current detection device is configured to detect a charging current that passes the charging device when the voltage applying device applies the voltage to the charging device. The control circuitry is configured to determine a film thickness of the photoconductor based on the charging current detected with the current detection device; determine an estimated film thickness being an estimated value of the film thickness, based on a previous film thickness previously determined by the control circuitry and travel information of the photoconductor after determination of the previous film thickness; determine a discharging start voltage that the voltage applying device applies to the charging device to start discharging from the charging device to the photoconductor; determine, from the estimated film thickness and the discharging start voltage, a film thickness determining voltage that the voltage applying device applies to the charging device to pass a film thickness determining current being a charging current used for determining the film thickness; and apply the film thickness determining voltage to the charging device to determine the film thickness.

In another embodiment of the present disclosure, there is provided an image forming apparatus that includes a rotatable photoconductor, charging means, voltage applying means, current detection means, and control means. The charging means charges the photoconductor by applying a voltage to the photoconductor. The voltage applying means applies the voltage to the charging means. The current detection means detects a charging current that passes the charging means when the voltage applying means applies the voltage to the charging means. The control means determines a film thickness of the photoconductor based on the charging current detected with the current detection means; determines an estimated film thickness being an estimated value of the film thickness, based on a previous film thickness previously determined by the control means and travel information of the photoconductor after determination of the previous film thickness; determines a discharging start voltage that the voltage applying means applies to the charging means to start discharging from the charging means to the photoconductor; determines, from the estimated film thickness and the discharging start voltage, a film thickness determining voltage that the voltage applying means applies to the charging means to pass a film thickness determining current being a charging current used for determining the film thickness; and applies the film thickness determining voltage to the charging means to determine the film thickness.

In still another embodiment of the present disclosure, there is provided a method of determining a film thickness of a rotatable photoconductor in an image forming apparatus. The image forming apparatus includes a charging device configured to apply a voltage to the photoconductor to charge the photoconductor, a voltage applying device configured to apply the voltage to the charging device, a current detection device configured to detect a charging current that passes the charging device when the voltage applying device applies the voltage to the charging device, and control circuitry configured to determine a film thickness of the photoconductor based on the charging current detected with the current detection device. The method includes determining an estimated film thickness being an estimated value of the film thickness, based on a previous film thickness previously determined by the control circuitry and travel information of the photoconductor after determination of the previous film thickness; determining a discharging start voltage that the voltage applying device applies to the charging device to start discharging from the charging device to the photoconductor; and determining, from the estimated film thickness and the discharging start voltage, a film thickness determining voltage that the voltage applying device applies to the charging device to pass a film thickness determining current being a charging current used for determining the film thickness.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 7 is a table of an example of estimated values of film thickness according to travel distances;

FIG. 10 is an example of a table of discharging start voltages according to environment information; and FIG. 11 is an example of a table of discharging start voltages according to history of environment information.

Figure 1:
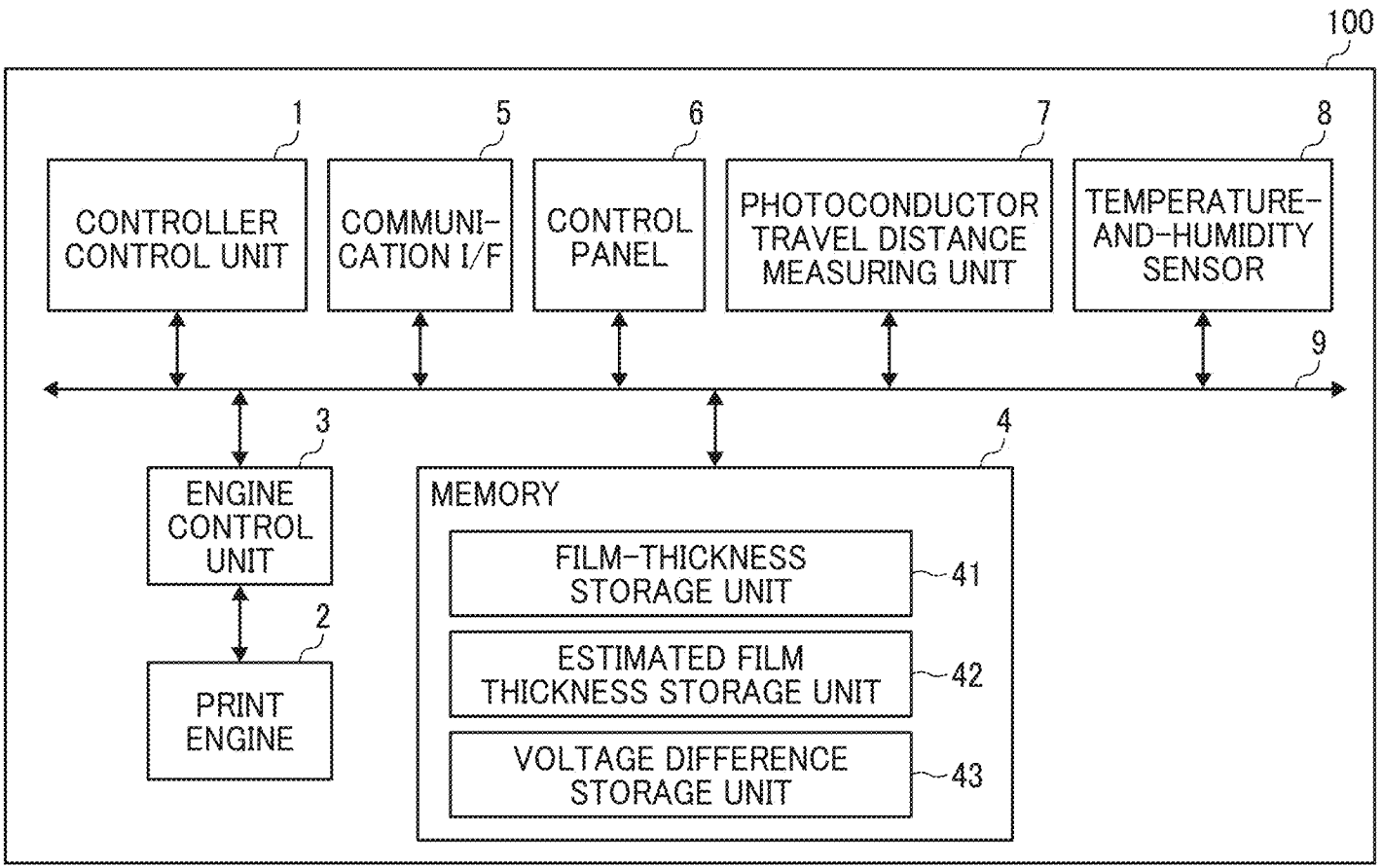
FIG. 1 is a diagram of a hardware configuration of an image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

An image forming apparatus 100 according to the present embodiment is a multifunction device called a multifunction peripheral/printer (MFP) that has a combination of, for example, a copying function, a facsimile function, a printer function, a scanner function, a function of executing image processing on an input image (e.g., an image read by the scanner function or an image input by the scanner function or the facsimile function), and a function of storing or distributing an input image.

The image forming apparatus 100 according to the present embodiment is an electrophotographic image forming apparatus that selectively exposes a charged surface of a photoconductor to write an electrostatic latent image, adheres toner to the electrostatic latent image, and transfers the toner onto a recording medium, such as a sheet of paper. In the present embodiment, image to be processed by the image forming apparatus 100 is assumed to include not only image data but also data that does not contain image data, that is, data that contains only text information.

FIG. 1 is a diagram of a hardware configuration of the image forming apparatus 100. The image forming apparatus 100 includes a controller control unit 1 that controls the entire image forming apparatus 100, a print engine 2 that is an image forming unit according to an electrophotographic process, an engine control unit 3 that controls the print engine 2, a memory 4 that stores various data relating to the image forming apparatus 100, a communication interface (I/F) 5 that is an interface for communication of the image forming apparatus 100 with an external device, a control panel 6 to receive operation for the image forming apparatus 100, a photoconductor travel distance measuring unit 7 that measures the travel distance that is a rotation distance of the drum-shaped photoconductor, a temperature-and-humidity sensor 8 that measures the temperature and humidity of the image forming apparatus 100, and a system bus 9 that mutually connects the foregoing components.

The controller control unit 1 controls the entire image forming apparatus 100. As an example, the controller control unit 1 is an integrated circuit (IC) that includes a central processing unit (CPU), a random access memory (RAM), and a read only memory (ROM). The CPU uses the RAM as a work area (working area) and executes a program stored in the ROM or the memory 4 to control the operation of the entire image forming apparatus 100 and achieve various functions such as the copying function, the facsimile function, the printer function, and the scanner function. Other examples of various functions include the management of communication with an external device and the instruction to start or end printing. The controller control unit 1 has a timer function and is capable of managing the time for achieving various functions.

The print engine 2, which is an example of the image forming unit, is hardware for achieving, e.g., the copying function, the facsimile function, the printer function, and the scanner function. In other words, the print engine 2 is hardware including, for example, a printer, a facsimile, and/or a scanner. The print engine 2 may include an optional device, such as a finisher that sorts printed sheets or such as an automatic document feeder (ADF) that automatically feeds an original document.

The engine control unit 3, which is control circuitry or control means, is connected to the print engine 2 to control the print engine 2 in response to an instruction from the controller control unit 1. The engine control unit 3 is, for example, an IC that includes a CPU, a RAM, and a ROM. The CPU uses the RAM as a work area (a working area) and executes a program stored in the ROM or the memory 4 to achieve various functions of the print engine 2. Examples of such various functions include printing according to an electrophotographic process.

The memory 4 as a storage device is a memory that stores programs and various data for operation of the image forming apparatus 100. The memory 4 is, for example, a ROM, a RAM, or a hard disk drive (HDD). For example, an operation system (OS) being basic software that controls the entire image forming apparatus 100, various application programs operable on the OS, and operating conditions for executing the various functions are preferably stored in the HDD or ROM as a non-volatile storage medium whose storage contents are not erased even when the image forming apparatus 100 is turned off. The memory 4 may also store operation results performed by various functions of the image forming apparatus 100 as log data each time.

In the present embodiment, the memory 4 includes a film-thickness storage unit 41, an estimated film-thickness storage unit 42, and a voltage difference storage unit 43 according to data to be stored. The film-thickness storage unit 41, the estimated film-thickness storage unit 42, and the voltage difference storage unit 43 may be different storage media or may be different storage regions of the same storage medium.

The communication I/F 5 is, for example, an interface for the image forming apparatus 100 to communicate with an external device via a network such as the Internet or a local area network (LAN). The image forming apparatus 100 accepts various data such as print instructions and image data from an external device by the communication I/F 5 and can input various data to an external device.

The control panel 6, which is an example of an operation unit, receives various inputs in response to the operation of the operator, and displays various information (e.g., information indicating received operation, information indicating the operation state of the image forming apparatus 100, and information indicating the setting state of the image forming apparatus 100). The control panel 6 is constituted by, for example, a liquid crystal display (LCD) device having a touch panel function. However, the control panel is not limited to the LCD device and may be constituted by, for example, an organic electro-luminescence (EL) display device having a touch panel function. Alternatively, in addition to or instead of the control panel 6, an operation unit such as hardware keys and an indicator such as a lamp may be provided.

The photoconductor travel distance measuring unit 7, which is the photoconductor running information acquisition unit, measures the travel distance obtained from the travel information, such as the rotation speed, of the photoconductor, and notifies the controller control unit 1 and the engine control unit 3 of the travel distance. Note that the IC itself constituting the engine control unit 3 may have a function of measuring the travel distance of the photoconductor and may function as the photoconductor travel distance measuring unit 7. The travel information is not limited to the travel distance and may be, for example, the travel time. The travel speed or the contact pressure with other members during traveling may also be used as the travel information.

The temperature-and-humidity sensor 8, which is an environment information acquisition unit, detects temperature and humidity as environment information, which is information of the environment in which the image forming apparatus 100 is installed, and notifies the controller control unit 1 and the engine control unit 3 of the temperature and humidity. The temperature-and-humidity sensor 8 is installed at an appropriate location in accordance with the specification and use of the environment information, such as the external periphery of the image forming apparatus 100, the interior of the image forming apparatus 100, and an area near a specific member inside the image forming apparatus 100, and the layout condition of the image forming apparatus 100. Note that the environment information may be one of temperature and humidity or may be obtained by using detection results of other sensors in addition to temperature and humidity.

The image forming apparatus 100 may also include an external interface to read and write an external recording medium, such as a compact disc (CD), a digital versatile disc (DVD), a secure digital (SD) memory card, or a universal serial bus (US) memory, via the external interface.

A program stored in the memory 4 is a program that can be processed by a computer. The program may be installed in the memory 4 at the time of manufacturing or shipment of the image forming apparatus 100 or may be installed after the sale. As a method of installing the program after the sale, for example, the program may be installed using an external storage medium, which stores the program, via an external storage medium or may be installed using the communication I/F 5 via the network.

Figure 2:
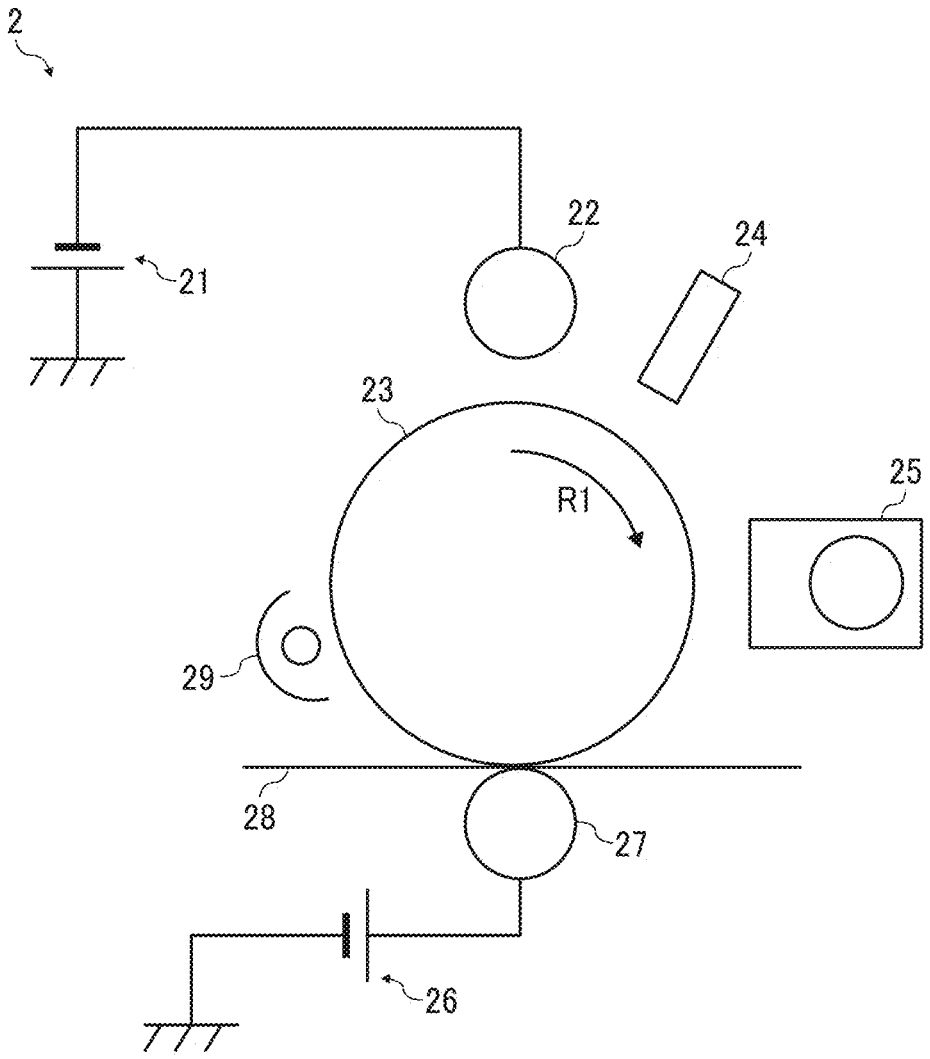
FIG. 2 is a diagram of a print engine of an image forming apparatus according to an embodiment of the present disclosure.

FIG. 2 is a diagram of a part of the print engine 2 according to an embodiment of the present disclosure.

As illustrated in FIG. 2, the print engine 2 includes a charging power source 21, a charging roller 22, and a photoconductor 23. The charging power source 21 is a power source that supplies power for charging. The charging roller 22 is charged by application voltage supplied by the power supply of the charging power source 21. The photoconductor 23 is a target of charging through the charging roller 22. The print engine 2 further includes an exposure device 24, a developing device 25, and a primary transfer power source 26. The exposure device 24 performs exposure according to an image signal to form an electrostatic latent image on the surface of the photoconductor 23. The developing device 25 develops a toner image on the surface of the photoconductor 23. The primary transfer power source 26 supplies power for primary transfer.

The print engine 2 further includes a primary transfer roller 27, an intermediate belt 28, and a neutralizer 29. Voltage is applied to the primary transfer roller 27 by the power supply from the primary transfer power source 26. The toner image on the surface of the photoconductor 23 is transferred onto the intermediate belt 28. The neutralizer 29 neutralizes the charge on the surface of the photoconductor 23 after the primary transfer.

For the operation of each part in FIG. 2, the high voltage generated by the power supply from the charging power source 21, which is a voltage applying device or voltage applying means, is applied to the charging roller 22. The photoconductor 23 adjacent to the charging roller 22, which is a charging device or charging means, has a shape of drum that is rotatable in a direction indicated by arrow R1 in FIG. 2. The surface of the photoconductor 23 is uniformly charged by the charging roller 22 while the photoconductor 23 rotates. Thereafter, the exposure device 24 exposes the charged surface of the photoconductor 23 with light in accordance with the image signal, and an electrostatic latent image is formed on the surface of the photoconductor 23. The electrostatic latent image is developed with toner by the developing device 25 into a visible image. Thus, a toner image is formed on the surface of the photoconductor 23.

Further, the high voltage generated by the power supply from the primary transfer power source 26 is applied to the primary transfer roller 27, thus causing the toner image on the surface of the photoconductor 23 to be primarily transferred to the intermediate belt 28 (primary transfer). Thereafter, the toner image transferred to the intermediate belt 28 is secondarily transferred to a recording medium (secondary transfer). In the case in which the neutralizer 29 is installed as illustrated in FIG. 2, charging is performed after the charge of the surface of the photoconductor 23 is neutralized by the neutralizer 29. The recording medium on which the toner image has been transferred is conveyed to a fixing device, and the toner image on the recording medium is heated by the fixing device to fix the toner image on the recording medium. Thus, a desired image is formed on the recording medium.

In the case of color printing, the photoconductors 23 for four colors are arranged side by side with respect to the intermediate belt 28. Toner images for four colors are primarily transferred separately onto the intermediate belt 28, and then the toner images are secondarily transferred onto the recording medium. Then, the toner images are fixed on the recording medium. Although various types of recording media are available in the present embodiment, the following description assumes "plain paper" as a typical recording medium. For example, coated paper, label paper, an overhead projector sheet, a film, or a flexible thin plate may be also used as the recording medium.

FIG. 2 illustrates a configuration of a non-contact charging type in which the charging roller 22 and the photoconductor 23 are separated from each other. In some embodiments, a contact charging type may be employed in which the contact charging type in which the charging roller 22 and the photoconductor 23 are in contact with each other.

Figure 3:
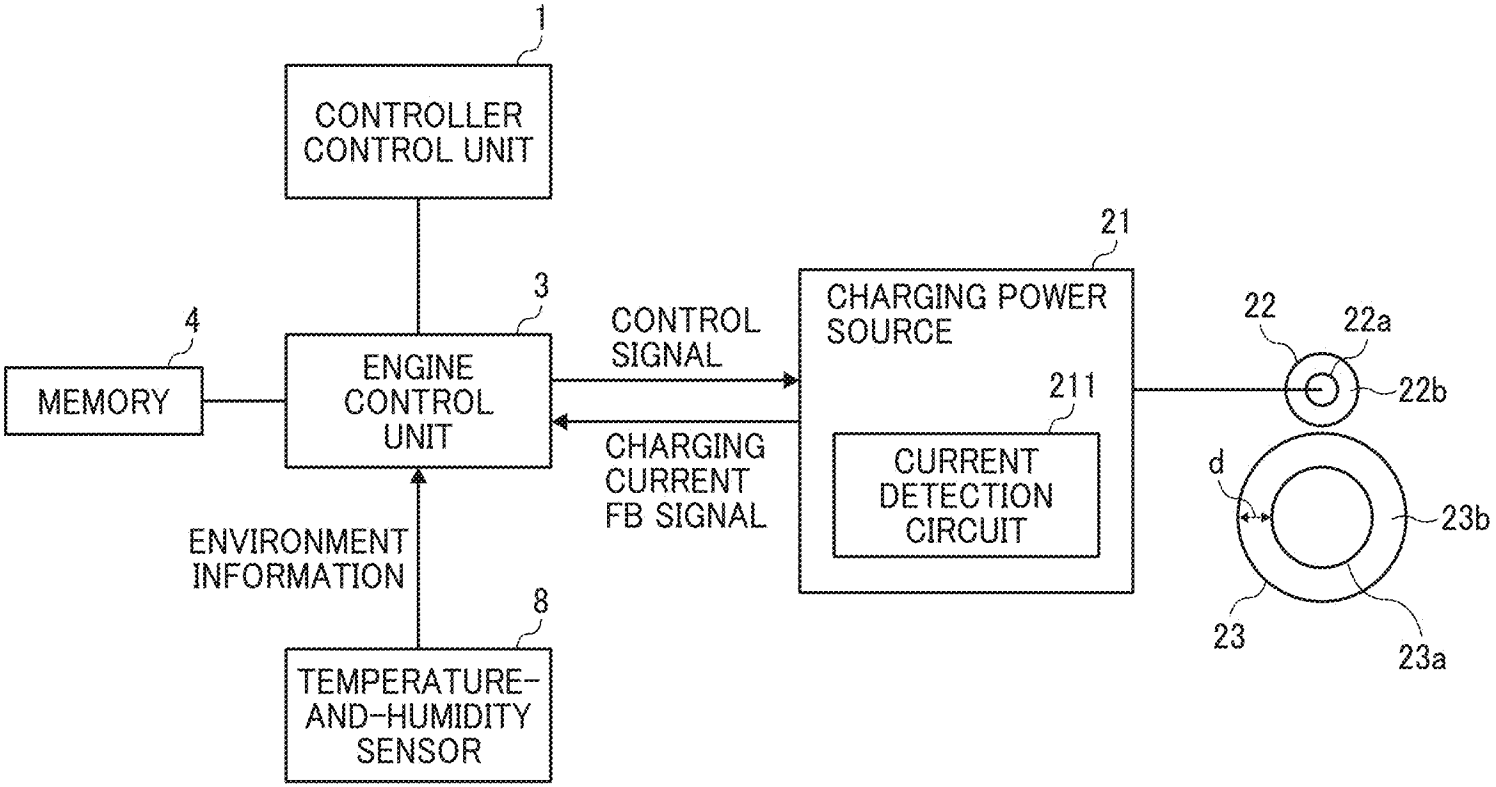
FIG. 3 is a diagram of a configuration of charging control of an image forming apparatus according to an embodiment of the present disclosure.

FIG. 3 is a diagram of a configuration of charging control according to an embodiment of the present disclosure.

In FIG. 3, the controller control unit 1, the engine control unit 3, the temperature-and-humidity sensor 8, the charging power source 21, the charging roller 22, and the photoconductor 23 are illustrated to describe the charging control.

The charging power source 21 includes a current detection circuit 211 to detect the current supplied by the charging power source 21 to the charging roller 22. The current detection circuit 211, which is a current detection device or current detection means, detects an output current from the charging power source 21 to the charging roller 22 and outputs the current to the engine control unit 3 as a charging current feedback (FB) signal. The current detection circuit 211 is, for example, a circuit capable of detecting an output current of the charging power source 21 but is not limited to such a circuit if the circuit can generate the charging current FB signal. In some embodiment, the current detection circuit may be, for example, a circuit that detects the current flowing from the charging roller 22 to the photoconductor 23 and returning to the charging power source 21. The charging current FB signal is, for example, an analog signal, but it is not limited to the analog signal.

The charging roller 22 includes, for example, a metal core 22*a* and a conductive elastic layer (conductive rubber layer) 22*b* on an outer periphery of the metal core 22*a*. The photoconductor 23 includes, for example, a filmy photoconductive layer 23*b* as a charged object on an outer peripheral surface of a conductive drum substrate 23*a*. The thickness d of the filmy photoconductive layer 23*b* from the surface of the conductive drum substrate 23*a* in the photoconductor 23 is referred to as film thickness.

Referring to the operations of each part of FIG. 3, the engine control unit 3 sends a signal to each part of the print engine 2 based on an instruction from the controller control unit 1 to control each part of the print engine 2. The charging power source 21 generates a charging voltage, for example, a direct current (DC) voltage, based on an output determined by a control signal, for example, a pulse width modulation (PWM) signal sent from the engine control unit 3.

When the charging roller 22 is charged by the voltage applied to the charging roller 22 from the charging power source 21 and applied to the charging roller 22 at a certain voltage or more, the charging roller 22 starts discharging the photoconductor 23 adjacent to the charging roller 22, thus causing the surface potential of the photoconductor 23 to start to rise. Accordingly, the charging to the photoconductor 23 is performed. In this manner, the voltage at which the discharge from the charging roller 22 to the photoconductor 23 is started is referred to as discharging start voltage.

The engine control unit 3 can determine various data, such as the discharging start voltage, which is the voltage at which the charging roller 22 starts discharging, and the film thickness of the photoconductor, based on the obtained charging current FB signal. The engine control unit 3 also receives a notification of temperature and humidity from the temperature-and-humidity sensor 8.

The memory 4 can store various data for the engine control unit 3 to execute the control. The engine control unit 3 can acquire various data stored in the memory 4 and store the determined various data in the memory 4.

Figure 4:
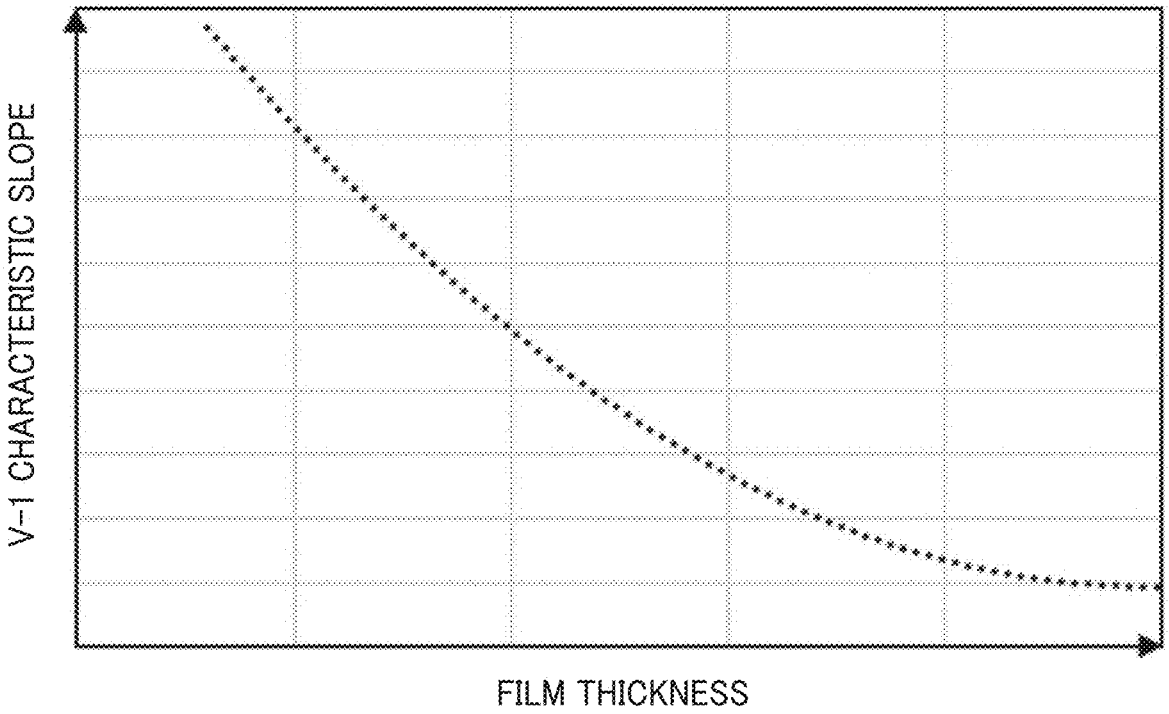
FIG. 4 is a graph of a relationship between film thickness of a photoconductor and slope of voltage-current characteristics of a charging device.

Here, a description is given of the relationship between the film thickness of the photoconductor and the voltage-current characteristics of the voltage applied to the charging roller and the charging current, which is the current flowing through the charging device when the voltage is applied to the charging roller. The relationship of the graph illustrated in FIG. 4 is known between the slope the voltage-current characteristics of the voltage applied to the charging roller and the charging current and the film thickness of the photoconductor. As illustrated in FIG. 4, the slope of the voltage-current characteristics (V-I characteristics) smaller as the film thickness of the photoconductor is greater. The slope of the voltage-current characteristics is greater as the film thickness of the photoconductor is smaller.

It is known that the relation between I=k/d (k is constant) is satisfied between the current I flowing through the charging roller in charging the photoconductor and the film thickness d of the photoconductor in a state in which the discharging is being performed from the charging roller to the photoconductor. Therefore, if the relationship of FIG. 4 is previously specified by, for example, the experiment or the simulation of one photoconductor, the film thickness of the photoconductor at a certain point in time can be determined by calculating the slope of the voltage-current characteristics of the voltage applied to the charging roller and the charging current at the certain point in time and referring to the relationship of FIG. 4.

When the slope of the voltage-current characteristics of the voltage applied to the charging roller and the charging current is calculated at a certain point in time, a plurality of different voltages being at least equal to or greater than the discharging start voltage may be applied to the charging roller to detect the charging current when each of the different voltages is applied. For example, the charging currents detected on application of four different voltages are plotted as illustrated in (1), (2), (3), and (4) of FIG. 5. The film thickness of the photoconductor can be determined by determining the slope from the graph of FIG. 5 and referring to the graph of FIG. 4 having been determined in advance. The discharging start voltage Vth can also be specified from the graph illustrated in FIG. 5. That is, the boundary at which the discharging is started is 0 in current or x intercept. Therefore, the value of the voltage of the x-intercept is the discharging start voltage Vth.

Figure 6:
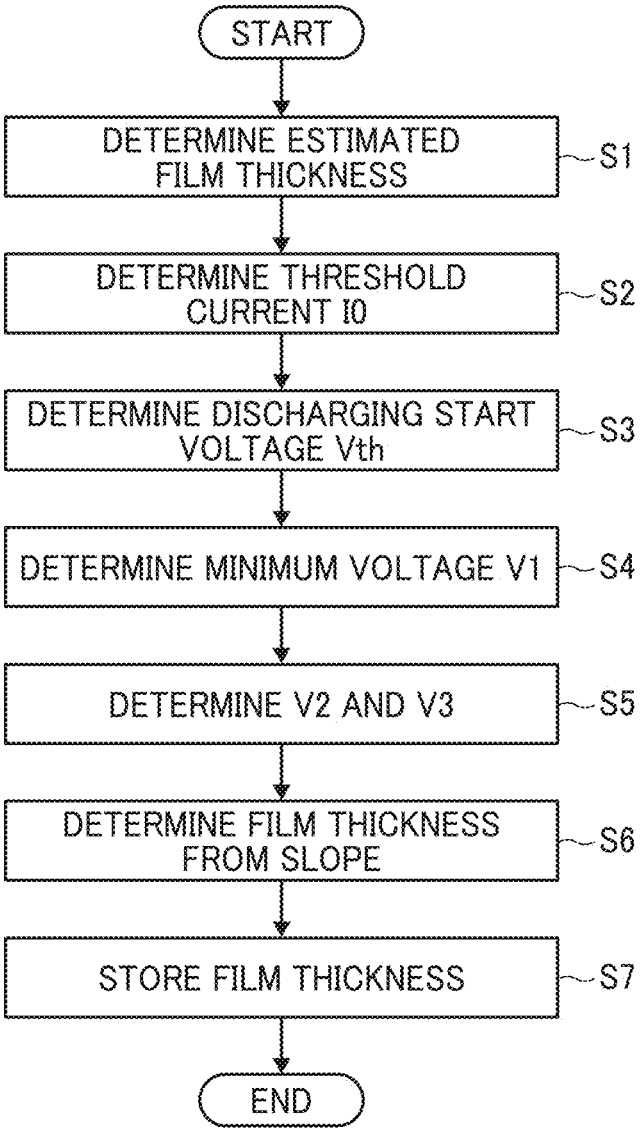
FIG. 6 is a flowchart of an example of a film-thickness determining process according to an embodiment of the present disclosure.

FIG. 6 is a flowchart of an example of a film thickness determining process according to an embodiment of the present disclosure.

First, the engine control unit 3 determines an estimated film thickness of the photoconductor 23 as an estimated-film-thickness determining step (step S1). For example, the engine control unit 3 acquires, from the photoconductor travel distance measuring unit 7, the travel distance TD of the photoconductor after determining the previous film thickness. The engine control unit 3 also acquires the film thickness previously determined, from the film-thickness storage unit 41. The engine control unit 3 determines the estimated film thickness with reference to the table illustrated in FIG. 7, which is previously stored in the estimated film-thickness storage unit 42. For example, if the travel distance TD of the photoconductor is between B meters and C meters after previously determining the film thickness, and the film thickness previously determined is 15 μm, the estimated film thickness becomes 13 μm. The table illustrated in FIG. 7 may be determined by a theoretical value, may be determined by an experiment in advance, or may be determined by simulation.

Next, as a threshold current determining step, the engine control unit 3 determines a threshold current I0 which is a lower limit of the charging current in which the film thickness of the photoconductor can be measured (step S2). In the present embodiment, the threshold current I0 of the photoconductor 23 is previously stored in the memory 4, and the engine control unit 3 acquires the threshold current I0 from the memory 4 to determine the threshold current I0. The threshold current I0 is set so as to be a threshold value that can determine the film thickness without being affected by noise and current detection accuracy. In other words, when the current is too small, various noises and current detection accuracy on the detection may affect the accuracy of the film thickness measurement. Therefore, the lower limit of the charging current, at which the film thickness of the photoconductor can be measured, is determined. The threshold current I0 may be set by a theoretical value or may be set by experiments in advance, or may be set by a simulation.

Figure 5:
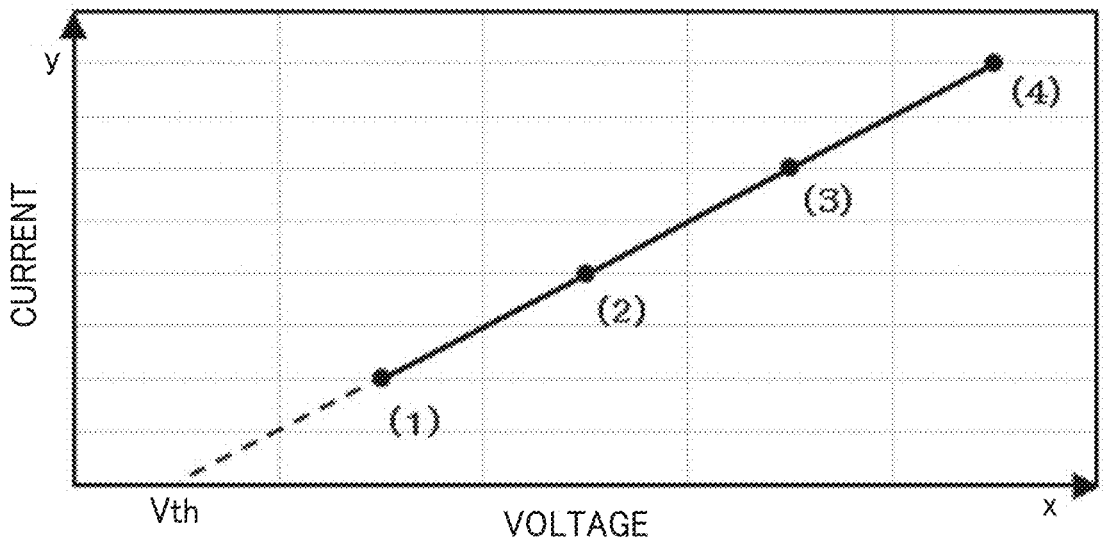
FIG. 5 is a graph of voltage-current characteristics of the charging device.

The engine control unit 3 determines the discharging start voltage Vth as the discharging start voltage determining step (step S3). That is, the voltage-current characteristics are determined from the charging current obtained when a plurality of different voltages, for example, the four different voltages illustrated in FIG. 5, are applied to the charging roller 22. The x intercept is determined to be the discharging start voltage Vth.

Figure 8:
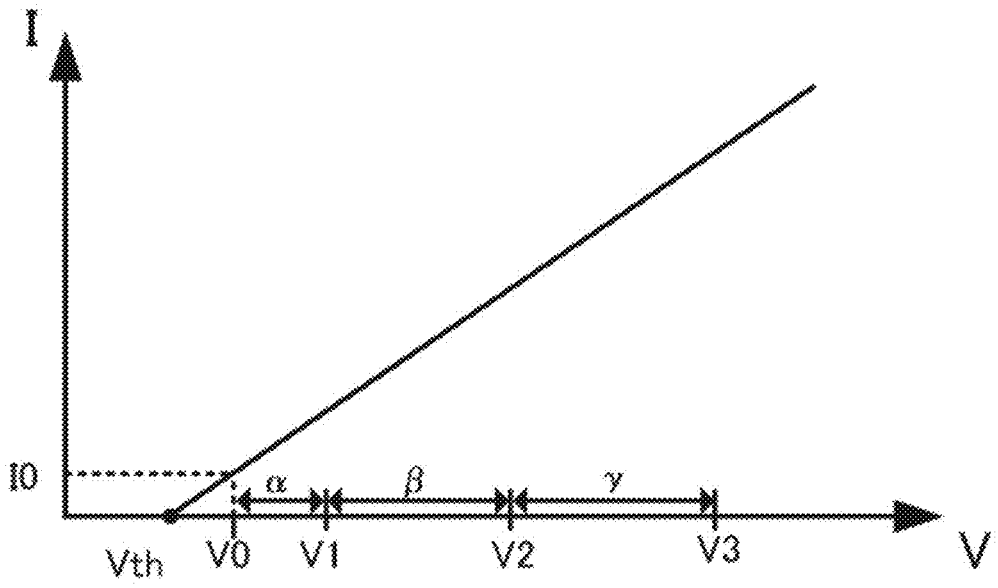
FIG. 8 is a graph of film-thickness determining voltage.

The engine control unit 3 determines a minimum voltage V1 that is the minimum value among the film-thickness determining voltages for passing the current having the threshold current I0 or greater as a first film-thickness determining voltage determination step (step S4). For example, as illustrated in FIG. 8, a linear function is determined in which the film thickness determined at step S1 is the slope and the discharging start voltage Vth determined at step S3 is the intercept point. The engine control unit 3 determines the voltage corresponding to the threshold current I0 as the threshold voltage V0, using the linear function determined. The engine control unit 3 determines, as the minimum voltage V1, a voltage obtained by adding a predetermined voltage α to the voltage V0. In the present embodiment, the predetermined voltage α is previously stored in the voltage difference storage unit 43. The engine control unit 3 acquires the predetermined voltage α from the voltage difference storage unit 43 and adds the predetermined voltage α the threshold voltage V0 to determine the minimum voltage V1.

As described above, an estimated film thickness, which is an estimated value of the film thickness, is determined based on a previous film thickness, which is a previously-determined film thickness, and travel information of the photoconductor after the previous film thickness is determined. The discharging start voltage, which is the voltage with which discharging from the charging device to the photoconductor is started, is determined. From the estimated film thickness and the discharging start voltage, the film-thickness determining voltage is determined that is a voltage to be applied by the voltage applying device to flow the film-thickness determining current, which is a charging current used for determining the film thickness. The film-thickness determining voltage is applied to the charging device to determine the film thickness. Such a configuration can determine the film thickness with high accuracy without deviating from the load range as the power source of the charging power source.

The control unit sets a voltage obtained by adding a predetermined voltage to the threshold voltage, which is a threshold voltage necessary for flowing a threshold current being a minimum current usable for determining the film thickness, to the minimum voltage being the minimum value of the film-thickness determining voltage. If the voltage applied to determine the film thickness is too close to the discharging start voltage, noise and current measurement accuracy may affect the film thickness determined. The discharging start voltage varies with the film thickness of the photoconductor and the environmental conditions. Therefore, the voltage obtained by adding an excess voltage corresponding to the predetermined voltage is set to the minimum voltage of the film-thickness determining voltage. Such a configuration can reliably perform discharging and flow a charging current sufficient to detect the film thickness without the influence of the noise and the current measurement accuracy. Such a configuration can determine the film thickness with high accuracy.

The engine control unit 3 further determines n film-thickness determining voltages of V2 and V3 (step S5) as the second film-thickness determining voltage determination step. For example, the engine control unit 3 adds a predetermined voltage β to the minimum voltage V1 to determine the voltage V2. Then, the engine control unit 3 adds a predetermined voltage γ, which is determined in advance, to the voltage V2 to determine the voltage V3. In other words, the engine control unit 3 adds a predetermined voltage β+γ, which is determined in advance, to the voltage V1 to determine the voltage V3. In the present embodiment, the predetermined voltages β and γ are previously stored in the voltage difference storage unit 43. The engine control unit 3 acquires the predetermined voltages β and γ from the voltage difference storage unit 43 to determine the voltage V2 and the voltage V3.

In such a manner, the engine control unit 3 determines a plurality of film-thickness determining voltages including the minimum voltage V1, V2, and V3, which are the minimum voltage V1 and the different film-thickness determining voltages V2 and V3 obtained by adding different predetermined voltages, for example, predetermined voltages β and β+γ to the minimum voltage V1. The engine control unit 3 determines voltage-current characteristics based on a plurality of charging currents flowing on application of the plurality of film-thickness determining voltages, and determines the film thickness of the photoconductor from the slope of the voltage-current characteristics. Although at least two points are used to determine the slope, the above-described configuration determines the film-thickness based on more measurement points, thus reducing sampling errors due to, for example, noise and abrasion wear of the photoconductor. In the present embodiment, the measurement points are three points of V1, V2 and V3 but are not limited to the three points. The film thickness may be determined by a greater number of measurement points than the present embodiment.

Figure 9:
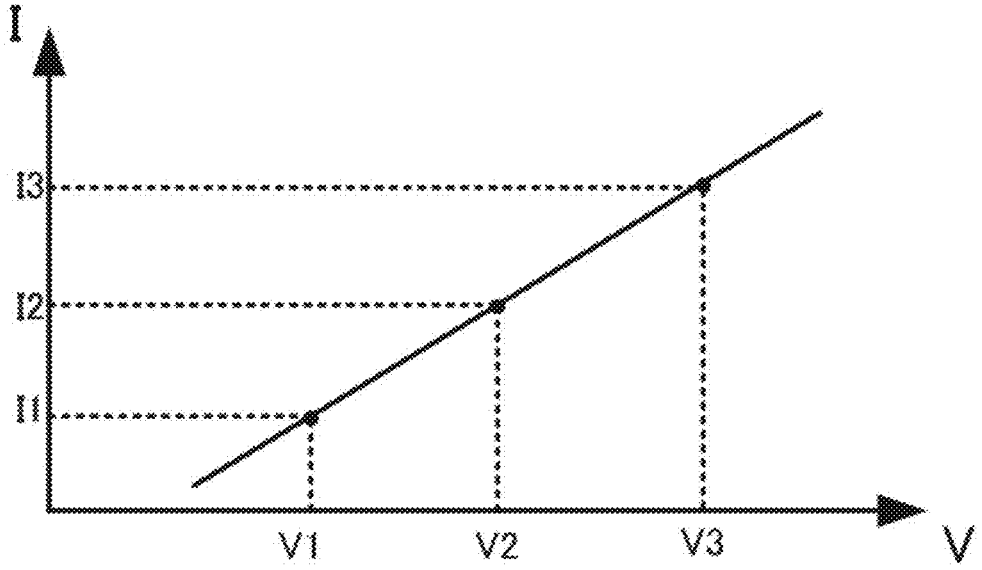
FIG. 9 is a graph of voltage-current characteristics against film-thickness determining voltage.

The engine control unit 3 determines the film thickness of the photoconductor as a film thickness determining step (step S6). For example, the engine control unit 3 controls the charging power source 21 to apply the determined film thickness determining voltages V1, V2, and V3 to the charging roller 22. When currents I1, I2, and I3 are detected for the film thickness determining voltages V1, V2, and V3, respectively, the voltage-current characteristics as illustrated in FIG. 9 are determined. The film thickness of the photoconductor is determined as the measured value from the slope of the determined V-I characteristics.

The engine control unit 3 stores the measured film thickness in the film-thickness storage unit 41 (step S7) and terminates the process flow.

The predetermined voltages α, β, and γ may be fixed values, such as α=β=γ=100V, but may also be variable values stored in a table format. That is, as the film thickness is larger and the temperature is lower, the discharge voltage Vth is greater. Therefore, variable values are set so as to vary so that the predetermined voltages α, β, and γ become smaller as the estimated film thickness is greater or the temperature is lower. Such a configuration can set the film-thickness determining voltages to a value not exceeding the rated voltage of the charging power source 21, that is, within the raged voltage range.

If the predetermined voltages β and γ are too low, the accuracy of the film thickness determined would be reduced by the influence of the sampling error. On the other hand, if the predetermined voltages β and γ are too high, the predetermined voltages β and γ would exceed the rated voltage of the charging power source 21. Therefore, the predetermined voltages β and γ are determined in consideration of the above-described condition.

In the present embodiment, all steps of the processing flow are executed by the engine control unit 3. In some embodiments, for example, a part of the processing flow may be executed by another control unit, such as the controller control unit 1, in the image forming apparatus 100.

Here, a first variation of the film thickness determining process is described below. In the description of FIG. 6, in step S1, the estimated film thickness is determined with reference to the table illustrated in FIG. 7. In the first variation, the estimated film thickness may be determined by calculating from the following equation (formula 1) using a film thickness abrasion rate. That is, the formula 1 is stored in the estimated film-thickness storage unit 42 and the estimated film thickness can be determined by the formula 1 with the previous film-thickness value acquired and the travel distance TD of the photoconductor.

$$\text{Estimated film thickness} = \text{Previous film thickness} - \text{Film thickness abrasion rate} \times \text{Photoconductor travel distance} \quad \text{(Formula 1)}$$

The film thickness abrasion rate is a film thickness value that is worn by a constant travel distance and is, for example, 0.15 μm/km. At this time, if the previous film thickness value is 20 μm and the photoconductor travel distance is 10 km, the present film thickness can be determined to be d=20 μm−(0.15×10)=18.5 μm.

Next, a second variation of the film thickness determining process is described. In the description of FIG. 6, the discharging start voltage Vth is determined based on the measurement in step S3. In the present second variation, the discharging start voltage Vth can also be determined by using a table illustrated in FIG. 10. That is, the engine control unit 3 acquires the temperature and humidity, which are detection results of the temperature-and-humidity sensor 8, from the temperature-and-humidity sensor 8 and determines which of, for example, LL representing low temperature and low humidity, MM representing moderate temperature and moderate humidity, and HE representing high temperature and high humidity applies to the environment information at the time. The engine control unit 3 determines, as the discharging start voltage Vth, one of the voltage values Vth1L to Vth5H corresponding to the environment information determined in the table illustrated in FIG. 10. In the environment of low temperature and low humidity in which the environment information in the table illustrated in FIG. 10 is LL and the estimated film thickness is 15 μm, the discharging start voltage is determined to be Vth1L. As described above, the discharging start voltage is determined corresponding to the environment in which the image forming apparatus 100 is installed, thus allowing the film thickness to be more accurately determined.

Next, a third variation of the film thickness determining process is described. In the description of FIG. 6, the discharge start voltage Vth is determined based on the measurement in step S3. In the present second variation, the discharge start voltage Vth can also be determined by using a table illustrated in FIG. 11. That is, the engine control unit 3 acquires the history of detection results of the temperature-and-humidity sensor 8, which is stored in the memory 4, and determines which of, for example, LL representing low temperature and low humidity, MM representing moderate temperature and moderate humidity, and HH representing high temperature and high humidity is included in the history of the environment information. The engine control unit 3 determines, as the discharging start voltage Vth, one of the voltage values Vth1L to Vth5H corresponding to the history of the environment information determined in the table illustrated in FIG. 11. As the history of the environment information, the engine control unit 3 may acquire the detection results of the temperature-and-humidity sensor 8 regularly, for example, every day from the time of determining the previous film thickness value and store the acquired detection results in the memory 4. In the environment of low temperature and low humidity in which the environment information in the table illustrated in FIG. 11 is LL and the estimated film thickness is 15 μm, the discharging start voltage is determined to be Vth1L. As described above, the discharging start voltage is determined corresponding to a change in the environment in which the image forming apparatus 100 is installed, thus allowing the film thickness to be more accurately determined.

In the second variation and the third variation, the environment information is determined using the detection results of the temperature-and-humidity sensor 8 but the environment information is not limited to the detection results of the temperature-and-humidity sensor 8. That is, a sensor that detects an environmental factor that may affect the discharging start voltage, such as a sensor that detects a substance that floats in the air and adheres to the surface of the photoconductor 23 and affect the characteristics of the surface of the photoconductor 23, may be suitably provided to determine the environment information and the corresponding discharging start voltage. In the second variation and the third variation, the environment information includes LL, MM, and HH, which are codes converted from the detection results of the sensor. In some embodiments, a table may be used in that the detection results of the sensor themselves are associated with the discharging start voltages.

Although the first variation, the second variation, and the third variation of the present embodiment are described above, another example of the film thickness determining process flow may execute the first variation as step S1 and the second variation as step S3 of the flowchart illustrated in FIG. 6. Still another example of the film thickness determining process may execute the first variation as step S1 and the third variation as step S3 of the flowchart illustrated in FIG. 6.

The present invention is not limited to embodiments described above. Various modifications can be made without departing from the scope of the technical gist of the present invention. The present invention includes all technical matters included in the technical idea described in the scope of the claims. The above-described embodiments are examples. A person skilled in the art can implement various alternatives, alternations, modifications, or improvements from the contents disclosed in the present specification, and these are to be included in the technical scope described in the scope of the accompanying claims. The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above. Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. An image forming apparatus, comprising:

a rotatable photoconductor;

a charging device configured to apply a voltage to the photoconductor to charge the photoconductor;

a voltage applying device configured to apply the voltage to the charging device;

a current detection device configured to detect a charging current that passes the charging device when the voltage applying device applies the voltage to the charging device; and control circuitry configured to:

determine a film thickness of the photoconductor based on the charging current detected with the current detection device;

determine an estimated film thickness being an estimated value of the film thickness, based on a previous film thickness previously determined by the control circuitry and travel information of the photoconductor after determination of the previous film thickness;

determine a discharging start voltage that the voltage applying device applies to the charging device to start discharging from the charging device to the photoconductor;

determine, from the estimated film thickness and the discharging start voltage, a film thickness determining voltage that the voltage applying device applies to the charging device to pass a film thickness determining current being a charging current used for determining the film thickness; and apply the film thickness determining voltage to the charging device to determine the film thickness.

2. The image forming apparatus according to claim 1, wherein the control circuitry is configured to determine a voltage obtained by adding a predetermined voltage to a threshold voltage for passing a threshold current being a minimum current usable for determining the film thickness, as a minimum voltage being a minimum value of the film thickness determining voltage.

3. The image forming apparatus according to claim 2, wherein the control circuitry is configured to:

determine a plurality of film thickness determining voltages including the minimum voltage and a different film thickness determining voltage obtained by adding another predetermined voltage different from the predetermined voltage to the minimum voltage;

determine a voltage-current characteristic based on the plurality of film thickness determining voltages and a plurality of charging currents generated by application of the plurality of film thickness determining voltages; and determine the film thickness from a slope of the voltage-current characteristic.

4. The image forming apparatus according to claim 3, wherein the voltage-current characteristic is expressed by a linear function having the discharging start voltage as an intercept and the estimated film thickness as a slope, and wherein the control circuitry is configured to determine a voltage corresponding to the threshold current to be the threshold voltage, and wherein the voltage corresponding to the threshold current is a predetermined value determined in advance based on the voltage-current characteristic.

5. The image forming apparatus according to claim 4, wherein the voltage applying device includes a power source, and wherein a maximum voltage of the plurality of film thickness determining voltages is within a rated voltage range.

6. The image forming apparatus according to claim 1, wherein the control circuitry is configured to determine the discharging start voltage from a voltage-current characteristic obtained when the charging device applies a plurality of different voltages to the photoconductor.

7. The image forming apparatus according to claim 1, wherein the control circuitry is configured to determine the discharging start voltage from the estimated film thickness and environment information in which the image forming apparatus is installed.

8. The image forming apparatus according to claim 1, wherein the control circuitry is configured to determine the discharging start voltage from the estimated film thickness and a history of environment information in which the image forming apparatus is installed.

9. The image forming apparatus according to claim 1, wherein the travel information includes a travel distance of the photoconductor.

10. The image forming apparatus according to claim 1, wherein the control circuitry is configured to determine the estimated film thickness based on a table of the estimated film thickness corresponding to the previous film thickness and a travel distance of the photoconductor.

11. The image forming apparatus according to claim 1, wherein the control circuitry is configured to determine the estimated film thickness from an equation of the estimated film thickness corresponding to the previous film thickness and a travel distance of the photoconductor.

12. An image forming apparatus, comprising:

a rotatable photoconductor;

charging means for charging the photoconductor by applying a voltage to the photoconductor;

voltage applying means for applying the voltage to the charging means;

current detection means for detecting a charging current that passes the charging means when the voltage applying means applies the voltage to the charging means; and control means for:

determining a film thickness of the photoconductor based on the charging current detected with the current detection means;

determining an estimated film thickness being an estimated value of the film thickness, based on a previous film thickness previously determined by the control means and travel information of the photoconductor after determination of the previous film thickness;

determining a discharging start voltage that the voltage applying means applies to the charging means to start discharging from the charging means to the photoconductor;

determining, from the estimated film thickness and the discharging start voltage, a film thickness determining voltage that the voltage applying means applies to the charging means to pass a film thickness determining current being a charging current used for determining the film thickness; and applying the film thickness determining voltage to the charging means to determine the film thickness.

13. A method of determining a film thickness of a rotatable photoconductor in an image forming apparatus, the image forming apparatus including a charging device configured to apply a voltage to the photoconductor to charge the photoconductor, a voltage applying device configured to apply the voltage to the charging device, a current detection device configured to detect a charging current that passes the charging device when the voltage applying device applies the voltage to the charging device, and control circuitry configured to determine a film thickness of the photoconductor based on the charging current detected with the current detection device, the method comprising:

determining an estimated film thickness being an estimated value of the film thickness, based on a previous film thickness previously determined by the control circuitry and travel information of the photoconductor after determination of the previous film thickness;

determining a discharging start voltage that the voltage applying device applies to the charging device to start discharging from the charging device to the photoconductor; and determining, from the estimated film thickness and the discharging start voltage, a film thickness determining voltage that the voltage applying device applies to the charging device to pass a film thickness determining current being a charging current used for determining the film thickness.

14. The method according to claim 13, wherein the determining the film thickness determining voltage includes determining a voltage obtained by adding a predetermined voltage to a threshold voltage for passing a threshold current being a minimum current usable for determining the film thickness, as a minimum voltage being a minimum value of the film thickness determining voltage.

15. The method according to claim 13, wherein the determining the film thickness determining voltage includes determining a plurality of film thickness determining voltages including the minimum voltage and a plurality of film thickness determining voltages obtained by adding each of a plurality of predetermined voltages to the minimum voltage.

* * * * *